United States Patent [19]

Makeev et al.

[11] 4,357,761

[45] Nov. 9, 1982

[54] APPARATUS FOR DRYING ENAMEL SLIP COATINGS ON PIPES

[76] Inventors: Anatoly E. Makeev, ulitsa Chekhova, 79, kv. 14, Rostov-na-Donu; Alexandr A. Sirotinsky, Fergansky proezd, 13, korpus 1, kv. 15, Moscow, both of U.S.S.R.

[21] Appl. No.: 223,311

[22] Filed: Jan. 8, 1981

[51] Int. Cl.[3] ..... F26B 15/20

[52] U.S. Cl. ..... 34/105; 34/21; 118/58; 427/239; 427/372.2

[58] Field of Search ..... 34/104, 105, 21; 118/58, 408; 427/230, 239, 372.2

[56] References Cited

U.S. PATENT DOCUMENTS 2,188,528 1/1940 Clark ..... 34/21

3,706,824 12/1972 Huber et al. ..... 34/104

3,816,938 6/1974 Podkletnov ..... 34/105

*Primary Examiner*—Larry I. Schwartz

*Attorney, Agent, or Firm*—McAulay, Fields, Fisher, Goldstein & Nissen

[57] ABSTRACT

Disclosed is apparatus designed primarily for enameling the internal and external surfaces of pipes including a drying chamber constructed as three vertical coaxial tubes, viz. an outer tube, an intermediate tube and a center tube, each having an individual hot air feed. The center and intermediate tubes are provided with holes in the upper part thereof and form an annular working space of the drying chamber. Movably mounted in said working space is a circular support for the pipe under treatment. This support is kinematically connected with a counterweight which is movably mounted inside the center tube and is constructed as an upside down cup with radial channels in the wall thereof.

6 Claims, 1 Drawing Figure

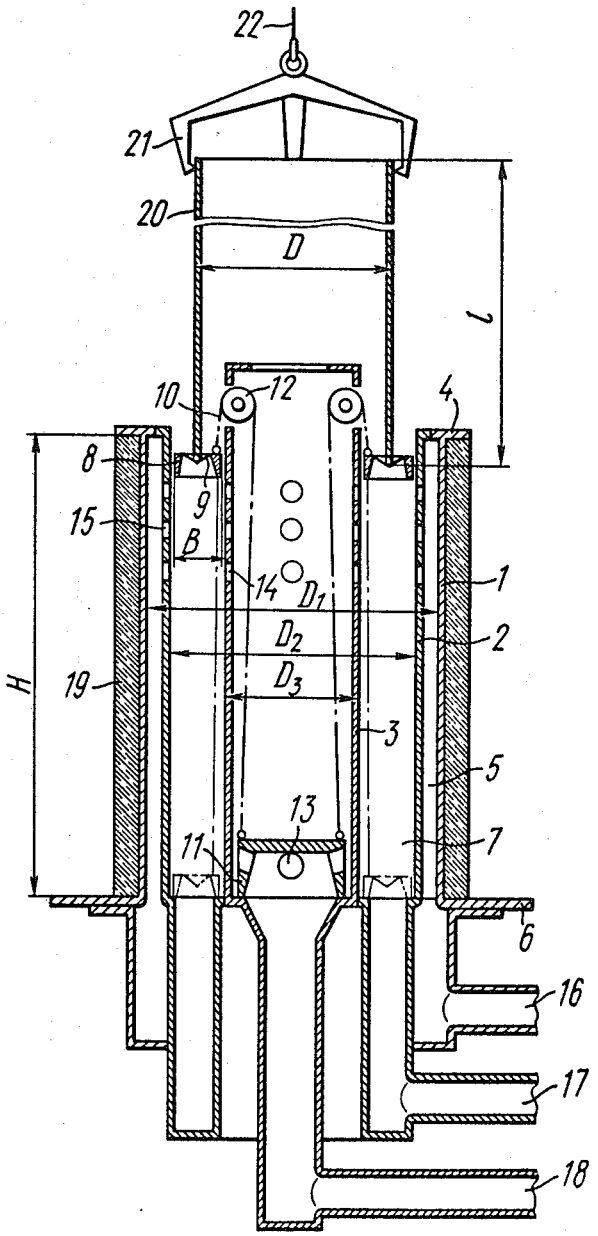
22
21
20
D
l
10
12
4
8
9
15
B
14
$D_1$
1
$D_2$
2
H
19
$D_3$
3
5
13
11
7
6
16
17
18

APPARATUS FOR DRYING ENAMEL SLIP COATINGS ON PIPES

FIELD OF THE INVENTION

The present invention relates to apparatuses for applying enamel coatings to pipes and has particular reference to apparatuses for drying enamel slip coatings on pipes.

The invention may be used with particular advantage for simultaneously enameling internal and external surfaces of pipes intended for use in underground water supply lines.

The invention may also be used in manufacturing enameled pipes for chemical, petroleum, atomic, foods, microbiological, metallurgical and ship-building industries and in other applications where pipe walls in contact with aggressive media have to be given lasting and reliable anticorrosion protection.

In industry there is an ever increasing need for pipes protected from the corrosive action of various materials conveyed in pipelines.

Experience has shown that the most lasting and reliable protection is given to underground pipelines by a coating of vitreous enamels of various compositions, which are by far more durable than coatings of bitumen and various kinds of organic materials and film.

To meet the stringent requirements concerning the quality of enamel coatings, such as 100 percent continuity, uniform thickness of the enamel coating, and freedom from sags, roughness and other defects, it is necessary to provide equipment capable of perfectly performing the various enameling operations.

One of the enamelling operations in question is drying enamel slip applied to the pipe surface.

THE PRIOR ART

In the statement of prior art, none of the apparatuses for drying enamel slip coatings on pipes can give the required quality of drying enamel slip on the internal and external surfaces of pipes, due to which the proper quality of enameled pipe surfaces fails to be obtained.

Known in the art is a pipe enameling apparatus (U.S.S.R. Inventor's Certificate No. 129448, Int. Cl. C23d 5/00) comprising an infrared gas-heated dryer for enamel slip. The dryer is constructed as a through chamber with radiant panels installed along the walls. The walls and the roof of the dryer are made of panels filled with slag wool. The dryer has a rigid framework which mounts a pushing rod conveyer which carries enameled pipes into and out of the dryer. The dryer is mounted on a foundation wherein, under the radiant panels, are provided two ducts which feed hot gas into said radiant panels. Circulation of gases in the dryer panels is effected by a fume exhauster situated beside the dryer.

The main disadvantage of this apparatus is that it is designed for drying an enamel slip coating only on the internal surface of a pipe.

Also known in the art is an apparatus for drying an enamel slip coating on the internal surface of a pipe (U.S.S.R. Inventor's Certificate No. 127897, Int. Cl. C329d 5/00), comprising a drying column adapted for the pipe under treatment to be lowered thereinto, a duct delivering hot air to the bottom end of the pipe, and a source of the hot air delivered by way of the duct to the pipe.

This apparatus suffers from the disadvantage that the hot air delivered to the bottom end of the pipe and coming in contact with the wet slip coating on the pipe surface converts into a steam-air mixture containing moisture, which mixture passes up the tube, comes in contact with the cold damp surface of the pipe upper part and cools down to the dew point, as a result of which part of the steam in the mixture condenses into drops which settle onto the pipe surface and flow down, washing out the thin layer of slip applied thereto, whereby the continuous coating is damaged and scrapped.

Another disadvantage is that hot air is delivered to the pipe only from the bottom end, which practically excludes the possibility of automating the process, inasmuch as the parameters of moist air inside the pipe are quite unstable and indefinite.

OBJECTS AND SUMMARY OF THE INVENTION

It is an object of the present invention to provide for enhancing the quality of pipe enamel coatings.

It is another object of the present invention to expedite the drying of enamel slip coatings on pipes.

It is still another object of the present invention to provide for simultaneously drying enamel slip coatings on internal and external surfaces of pipes.

It is still another object of the present invention to provide for automatic control of the drying process.

These and other objects are achieved in an apparatus for drying enamel slip coatings on pipes, comprising a drying chamber the bottom part of which communicates with a duct for feeding hot air into the chamber working space adapted to accommodate a pipe coated with enamel slip. The drying chamber is constructed as three vertical coaxial tubes, viz. an outer tube, an intermediate tube and a center tube, each having an individual hot air feed. The center and intermediate tubes have holes and form an annular working space wherein is mounted a movable perforated circular support for the pipe under treatment. Said support is kinematically connected with a counterweight situated inside the center tube.

The drying chamber construction in the form of three vertical coaxial tubes feeding hot air into various zones of the drying chamber working space via individual air ducts provides for simultaneously heating the entire enamel slip coating on the pipe under treatment.

Feeding hot air into various zones in the drying chamber height prevents condensation of the moisture evaporated from the enamel slip coating in the drying process and thereby obviates the possibility of washing out the enamel slip coating on the pipe wall, thus providing proper continuity and high quality of the coating.

Furthermore, feeding air through individual ducts enables automating the heating process by regulating the amount of air coming into the various zones of the working space.

The counterweight, which is kinematically connected with the movable support and is adapted to move inside the center tube of the drying chamber, ensures constant contact between the movable support and the end of the pipe in the drying process during both the lowering of the pipe into the drying chamber and the raising thereof.

The counterweight constantly holds the movable support against the pipe end as the pipe is lowered into the drying chamber during the drying process and thereby obviates the possibility of the pipe touching the walls of the drying chamber due to some minor fault (the pipe being out of straight, accidental fluctuation of the pipe hoisting mechanism, etc.) and prevents mechanical damage to the enamel slip coating on the pipe.

The movable perforated circular support, which is adapted to move in the annular space between the center and intermediate tubes of the drying chamber, aligns the pipe during the drying process and thus prevents the pipe coated surfaces from accidentally touching the walls of the drying chamber. The perforations provided in the support allow free passage of the air flow into the working space of the drying chamber.

It is desirable that the counterweight should be constructed as an upside-down cup with radial channels in its wall.

The radial channels in the wall of the counterweight, whose blind end obstructs the interior of the center tube, enable hot air to pass into the working space of the drying chamber throughout the counterweight up and down movement, in addition to the hot air passing through the clearance between the counterweight and the wall of the center tube.

This construction of the counterweight provides a constant flow of hot air to the center tube wall during counterweight movement.

It is further desirable that the holes provided in the center and intermediate tubes be located in the upper part thereof. Such a location of the holes provides for effective feed of hot air from the center tube onto the internal surface of the pipe under treatment and from the annular working space onto the external surface of the same.

Also, the location of the holes in the upper part of the center and intermediate tubes provides for feeding hot air into the zones where condensate is likely to form from the moisture evaporated from the enamel slip coating on the pipe.

Feeding hot air only to the lower part of the pipe results in that the upflowing air gradually becomes saturated with steam which, on encountering cold surfaces above, condenses into drops and the resultant liquid washes out the enamel slip, adversely affecting the continuity of the coating.

Independent feed of air into the various ducts and working space zones makes it possible to effect the drying of enamel slip coatings on the external and internal surfaces of pipes either separately or simultaneously.

BRIEF DESCRIPTION OF THE DRAWING

For a better understanding of the objects and advantages of the present invention, an embodiment thereof will now be described in detail with reference to the accompanying drawing which is a vertical sectional view of the drying chamber of the apparatus according to the invention.

The apparatus comprises a drying chamber composed of three vertical coaxial tubes, viz. an outer tube 1, an intermediate tube 2 and a central tube 3. The tubes 1 and 2 are coupled at the top by a blind ring 4, forming an air duct 5. The bottom ends of the tubes 1 and 2 rest on a base 6 which supports the drying chamber and mounts the central tube 3. The central tube 3 and the intermediate tube 2 form an annular working space 7 wherein is installed a movable perforated circular support 8 with a circular tapered recess 9. The support 8 is connected by means of flexible connecting means 10 to a counterweight 11 situated inside the center tube 3. The counterweight 11 is constructed as an upside-down cup and the side wall thereof has radial holes 13 for the passage of hot air from the central tube 3 to holes 14 in the upper part thereof and thence into the upper part of the working space 7. The upper part of the wall of the tube 2 has radial holes 15 for the air to pass from the duct 5 into the upper part of the working space 7. The air duct 5, the working space 7 and the interior of the tube 3 are connected in the base 6 with independent air distributing ducts 16, 17 and 18 respectively. On the outside surface the tube 1 is provided with a heat insulating coating 19 of polyurethane or foam plastic to prevent heat loss by rejection to the surrounding medium.

The apparatus operates as follows:

The pipe 20, coated with wet enamel slip, is carried by an appropriate mechanism to the drying chamber and positioned over the movable circular support 8.

In the initial stage of the drying process the movable perforated support 8 is held in the uppermost position (shown by the broken line in FIG. 1) by the agency of the counterweight 11.

The drying air is heated by the use of conventional means (a heater operated by electricity, heating agent, etc.) and is delivered by a fan to the air distributing ducts 16, 17 and 18.

The distributing ducts 16, 17 and 18 feed the hot air into the working space 7. On passing over the walls of the tubes 1, 2 and 3, the hot air is discharged from the apparatus. The pipe 20 coated with enamel slip is suspended by a gripper 21 and a hoist cable 22 and is lowered onto the support 8, being aligned by the recess 9. The mass of the pipe 20 forces the support 8, against the action of the counterweight 11, into the lower zone of the working space 7. Thereafter the pipe 20 is raised by the hoist, being subjected to the action of the hot air whereby the coating on the pipe 20 is dried.

The provision of three independent hot air ducts 16, 17 and 18 makes it possible to effect automatic regulation of air feed by using appropriate pickups installed in the working space 7 and arranged to send signals to a program controller of throttle valves (not shown) provided in the ducts 16, 17 and 18.

The apparatus described above was tested by treating a pipe of 300 mm diameter by 10 m long, coated on its internal and external surfaces to a thickness of 120 to 140 μm with enamel slip having up to 40 percent moisture content.

For a pipe with the above-stated measurements, the major components of the apparatus had the following specification:

| | |
|---|---|
| Depth of the working space 7 | H = 10.5 m |
| Diameter of the outer tube 1 | $D_1$ = 630 mm |
| Diameter of the intermediate tube 2 | $D_2$ = 426 mm |
| Diameter of the center tube 3 | $D_3$ = 194 mm |
| Width of circular support 8 | B = 220 mm |

With hot air fed into the working space 7 at a temperature of 75°–80° C., the duration of the drying process is 3 to 5 minutes. The overall consumption of hot air is determined by thermodynamic calculations with respect to the physicomechanical properties and moisture content of the enamel slip being used. The hot air feed to the various zones of the working space 7 is regulated by the use of appropriate devices provided in the air distributing ducts and is determined by experience with enamel slip of various physicomechanical properties.

The coaxial tubes 1, 2 and 3 of the apparatus may be made of low carbon steel. The surfaces of the tubes 1, 2 and 3 in contact with hot air should be sufficiently smooth to obviate dust accumulation. The tubes 1, 2 and 3 may be coated with paint capable of withstanding temperatures up to 100° C. or they may be provided with other types of anticorrosion coating.

The movable perforated support 8 may be made of bronze, brass, stainless steel or another material that will not be corroded by contact with enamel slip.

For the heat insulation material 19, use may be made of various thermoplastics (polyurethane, foam plastic, etc.) capable of withstanding temperatures up to 100° C.

What is claimed is:

1. Apparatus for drying enamel slip coatings on pipes, comprising;

a drying chamber formed of three vertical coaxial tubes including an outer tube, an intermediate tube and a central tube;

said central and intermediate tubes having apertures therein;

said central and intermediate tubes forming an annular working space;

means for the independent feed of drying air into the bottom part of each of said tubes;

said intermediate and outer tubes being interconnected at their uppermost end by an annular ring forming therewith an air duct communicating with said work space through said apertures in said intermediate tube;

said central tube having means at the upper end thereof to prevent exhaust of air directly out the top thereof without passing through said apertures into said work space;

a perforated annular support movably mounted in said work space and adapted to support a pipe to be treated, said pipe surround said central tube so as to dry the inner and outer walls of said pipe; and a counter weight movably mounted inside said center tube and kinematically connected with said support for moving said pipe in said working space over said movable support.

2. The apparatus of claim 1, wherein said counter weight is formed as an upside-down cup having radial channels in the wall thereof.

3. The apparatus of claim 1, wherein said central and intermediate tubes have apertures in the upper part thereof.

4. The apparatus of claim 1, wherein said outer tube has a heat insulating coating to prevent heat loss to the surroundings.

5. The apparatus of claim 1, wherein said support has a recess for aligning said pipe.

6. The apparatus of claim 4, wherein said coating consists of polyurethane or foamed plastic.

* * * * *